US006932020B2

(12) United States Patent
Everett

(10) Patent No.: US 6,932,020 B2
(45) Date of Patent: Aug. 23, 2005

(54) BOAT BOARDING DEVICE

(76) Inventor: Donald L. Everett, 2030 Meadowbrook Dr., Vail, CO (US) 81957

( * ) Notice: Subject to any disclaimer, the term of this patent is extended or adjusted under 35 U.S.C. 154(b) by 0 days.

(21) Appl. No.: 10/899,238

(22) Filed: Jul. 26, 2004

(65) Prior Publication Data

US 2005/0028719 A1 Feb. 10, 2005

Related U.S. Application Data

(60) Provisional application No. 60/492,389, filed on Aug. 4, 2003.

(51) Int. Cl.[7] ..... B63B 17/00
(52) U.S. Cl. ..... 114/362
(58) Field of Search ..... 114/263, 362; 182/196, 206; 405/218, 219, 220, 221

(56) References Cited

U.S. PATENT DOCUMENTS 4,019,214 A 4/1977 Shaw
4,652,246 A 3/1987 Thorgeirsson et al.
4,773,887 A 9/1988 Steffanus
4,838,735 A * 6/1989 Warner ..... 405/220
4,854,257 A * 8/1989 Grayson ..... 114/61.23
5,301,630 A 4/1994 Genovese et al.
6,273,774 B1 8/2001 Warzecha
6,578,510 B1 * 6/2003 Scruggs et al. ..... 114/362
6,722,307 B1 * 4/2004 Rogers ..... 114/362

* cited by examiner

*Primary Examiner*—Lars A. Olson
(74) *Attorney, Agent, or Firm*—Paul M Denk

(57) ABSTRACT

A boat boarding device for use in combination with the side or transom of a boat, the device hingedly connects with the boat, can be pivoted downwardly into the water, adjusted by an adjustment device for maintaining its horizontal stability, and in addition, floatation devices may be employed, with the side framework of the device, for maintaining the device in a horizontal position upon the water during usage and application. A perforated platform is arranged along the bottom framework of the device, and a step, associated with the bottom platform, allows for stepping from the boat, onto the platform, to facilitate movement into the water, or for returning from the water into the boat.

9 Claims, 4 Drawing Sheets

BOAT BOARDING DEVICE

CROSS REFERENCE TO RELATED APPLICATION

This non-provisional patent application claims priority to the provisional application for patent having Ser. No. 60/492,389, which was filed on Aug. 4, 2003.

BACKGROUND OF THE INVENTION

This invention relates principally to a Boat Boarding Device, and more specifically pertains to a platform assembly for hingedly or otherwise connecting to an edge of a boat, whether it be a pleasure boat, cruiser, sailboat, or the like, and for the use for facilitating the leaving of water and boarding a boat, for the swimmer, etc., or to ease the transition from the boat into the water, when swimming.

Various types of devices have long been available for assisting the swimmer, scuba diver, or other aquatic adventurer, while leaving the boat, entering the water, or for return to the same. For example, ladders have long been available for attaching to the sides or back of various types of crafts, so that the swimmer can climb over the side of the vessel, climb down the ladder, and enter the water, to ease his transition to the same. Likewise, when leaving the water and re-boarding a boat, after swimming, scuba diving, snorkeling, or the like, such a ladder has made it easier for climbing back into the boat.

There may be various types of floatation devices, perhaps even made of plastic, which may be used for a similar or related purpose, but the concept of this invention is to provide a more structured device, that incorporates floatation means, and when arranged into position, can allow for the ease of transition into or from the water, as desired.

SUMMARY OF THE INVENTION

This invention relates generally to a boat boarding device, which has a structured frame, or fabricated device, having various platforms integrated therein, and which can be linked, hinged, or otherwise connected to the side or back, but preferably the transom or swim platform of a boat, to function as an extension of a swim platform, or to allow for movement from the water back into the boat, after an aquatic adventure.

More specifically, this device is fabricated of a series of frame components, the bottom of which integrates a platform, upon which the swimmer may stand or rest. In addition, the platform may incorporate a seat structure, at its inward end, and upon which the swimmer may sit, or step when moving into the water, or returning from the same. In addition, the frame structure and the platform includes an adjustment device, incorporating one or more rod extensions, and which may be set to a length that provides for contact with the lower part of the transom, or side of the boat, so that when the platform is pivoted into a useable position, partially within the water, the device will be generally horizontally disposed, so as to allow for the swimmer to stand reasonably erect, during usage.

The back or boat side of the frame includes means for hinging the platform device to the boat, and it may be connected by means of straps, metal hinges, D-rings, or other rings with cables, and which can connect to or hook over the upper edge of the side of the boat, or its transom, or swim platform to provide for its installation. During usage, the platform will be pivoted downwardly into the water. The platform will be submerged into the water so that the platform partially submerges, when placed into its operative position. Or, because of the hinge connection, the platform device may be pivoted upwardly, into a non-usable position, for storage, as when not in use.

More significantly, the platform will have connected to it one or more floatation devices. These floatation devices may be fabricated of either inflatable bladders, foam, or other floating type of components, and which will allow for the platform to submerge partially into the water, up to the level of the floatation devices, when it is pivoted into its usable configuration. Floatation devices may be strapped, connected, or secured in any fashion that allows for their firm connection to the upper sides of the platform device, as during usage.

This boat boarding device is attached to the transom or swim platform of a vessel, thus allowing a person (swimmer) or even small animals such as a dog, to swim, or to crawl onto the lower submerged, grated platform of the device, then allowing such parties to step up onto the elevated portion of the platform, which may also function as a seat, to step or to crawl while boarding the vessel itself. In addition, the device may be useful for a floatation device upon emergency vessels, and which can be pivoted into a usable position, to function as a means for retrieval or rescue either from such a vessel, or it may be independently used as a rescue device, since it will float upright on its own, due to the integration of the floatation devices within its structure.

One or more retractable adjustment devices will extend parallel to the mainframe of the device, either extending from their back, which may pivot into a non-useable position, or simply strapped onto the platform, floor or base for the device, and which can extend towards the transom of the vessel, thus, when weight is added to the device, the extended adjustment devices will be pushed against the vessel, keeping the boarding device reasonably level and stable in the water, to assure efficient and safe usage. Furthermore, the floatation devices, such as the bladders, pods, or the like, will also keep the device reasonably level fore and aft, and port and starboard. The floatation devices are located at the upper section of the main frame for the device, and may be attached by snapping them into place, through the use of straps, or other connecting means. The lower portions of the floatation devices, or pods, normally will sustain at the same level as the water, due to their high efficiency of floatation relative to any water upon which the pods or bladders rest.

Attachment of the device to the vessel is accomplished by one or more rings, at the upper boat side of the rear of the boarding device, such attachments connecting with the main frame of the device, and which also attach to the vessel, through the use of various clip rings, or the like, that may slip through eye-bolts attached to the swim platform, or to the transom of the vessel, in preparation for usage. The device can be raised to an upright position for storage while the vessel is underway.

The main frame of the device is also constructed so that it may be collapsible, as when not in use and stored. For example, floatation devices may be removed. The platforms may be removed. The structure of the main frame is fabricated such that the bottom edge of the side portions of the frame are capable of pivoting, inwardly, one upon the other, to provide for collapsing of the entire frame of the device and platform into a much lesser size, to facilitate its carrying, and storage. The main frame of the device may be formed of PVC pipe, and its various connecting components, such as lineal lengths, tee-sections, and the like, with the tee-sections functioning as the hinge means, at the bottom edges of the sides of the frame, to allow for that hinged collapse, when desired. Or, the main frame may also be made of any other materials, preferably those that are rust proof, such as stainless steel, aluminum, fiberglass, or the polyvinyl pipe, as noted. The floatation pods themselves may be made of a closed cell polymer, rubber, or vinyl, or may be made of foam, as stated, or made be made as rubber pods, which may be inflatable, for use for floatation purposes.

It is, therefore, the principal object of this invention to provide a floatation device that can be used in conjunction with the vessel, facilitate boarding or exiting of the vessel, particularly by a swimmer, and the like.

Another object intends to provide a boat boarding device that may be used for rescue purposes.

A further object of this invention is to provide a boat boarding device that can be used independently, for floatation, for rescue purposes, or even for recreation, as may be desired.

Still another object of this invention is to provide a boat boarding device that can be hingedly or otherwise linked to the sides, back, ,transom, or even to the front of a boat, such as a house boat, and which when arranged into a useable position, or pivoted into its utilitarian location, facilitates boarding of the boat by a swimmer or scuba diver and the like, or eases the entrance into the water, when applied.

Other objects of these inventions are to provide a boat boarding device that incorporates floatation means, to facilitate its balancing within the water, when arranged for usage.

Still another object of this invention is to provide a boat boarding device which incorporates adjustment means that facilitate the horizontal maintenance of the device in the water in preparation for usage.

Still another object of this invention is to provide a boat boarding device that incorporates adjustment means that can be re-adjusted, depending upon the incline or slope or the transom, or side of the vessel, so that the hinged connection of the platform to the vessel, when arranged in the water, will normally be sustained at a horizontal position.

Another object is to provide a boat boarding device that will be resistant to corrosion, even when used in water for a sustained period of time.

These and other objects may become more apparent to those skilled in the art upon review of the summary of the invention as provided herein, and upon undertaking a study of the description of its preferred embodiment, in view of the drawings.

BRIEF DESCRIPTION OF THE DRAWINGS

In referring to the drawings.

The same reference numerals refer to the same parts throughout the various figures.

DESCRIPTION OF THE PREFERRED EMBODIMENT

Figure 1:
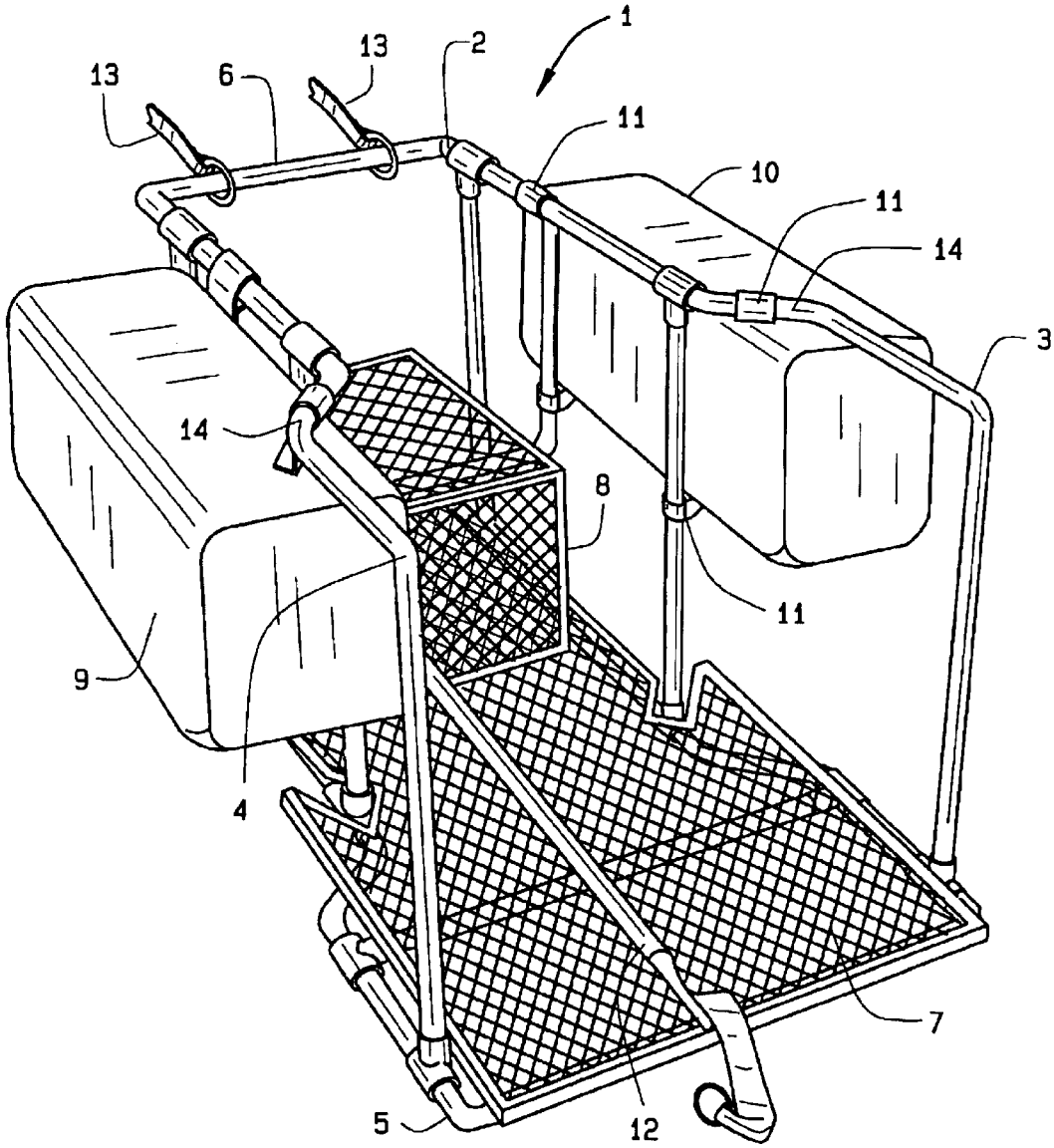
FIG. 1 is an isometric view of the boat boarding device of this invention.

Referring to the drawings, and in particular FIG. 1, the boat boarding device 1 of this invention is readily disclosed. It includes a framework 2, fabricated of side panels 3 and 4, a bottom frame 5, and a front frame rail 6. Front rail frame 6 may be removable, when it is desired to collapse the side frames overlying the bottom frame 5, for removal, storage, and collapse of the device.

The device incorporates a base platform 7, which further includes an elevated platform or step 8, so that the user can enter onto the platform 7, step up on the member 8, upon entering into or exiting from the boat, during usage of this device. The device also incorporates a pair of floatation means 9 and 10 which may be connected, such as by straps 11, or other connecting devices, for securement with the upper portion of the side frames, as noted in preparation for usage. Hence, the floatation devices, which may be fabricated in the manner as previously described and summarized, such as bladders, foam, or any other means for providing floatation to the device, when lowered into the water, can be used for this purpose.

An adjustment means, such as the rod 12, is operatively associated with the bottom of the framework, near the platform, or even under it, can be adjustably strapped into position, so as to extend out the boat end of the device, and act as a stabilizer for maintaining the device approximately horizontal, during usage, after it has been pivoted, about its hinged means 13, into the water and partially submerged, as during usage and application.

In addition, the side frames 3 and 4 may show that there is a slight widening, as at 14, so as to facilitate entrance upon or departure from the bottom platform 7, during usage, for the convenience of the swimmer. Or, the side frames may not incorporate the bulge or widening feature, as in 14 but may be lineal aligned, so as to facilitate the pivot downwardly of the side frames, into the non-usable condition, as when the device is prepared for removal and storage from the boat.

Figure 2:
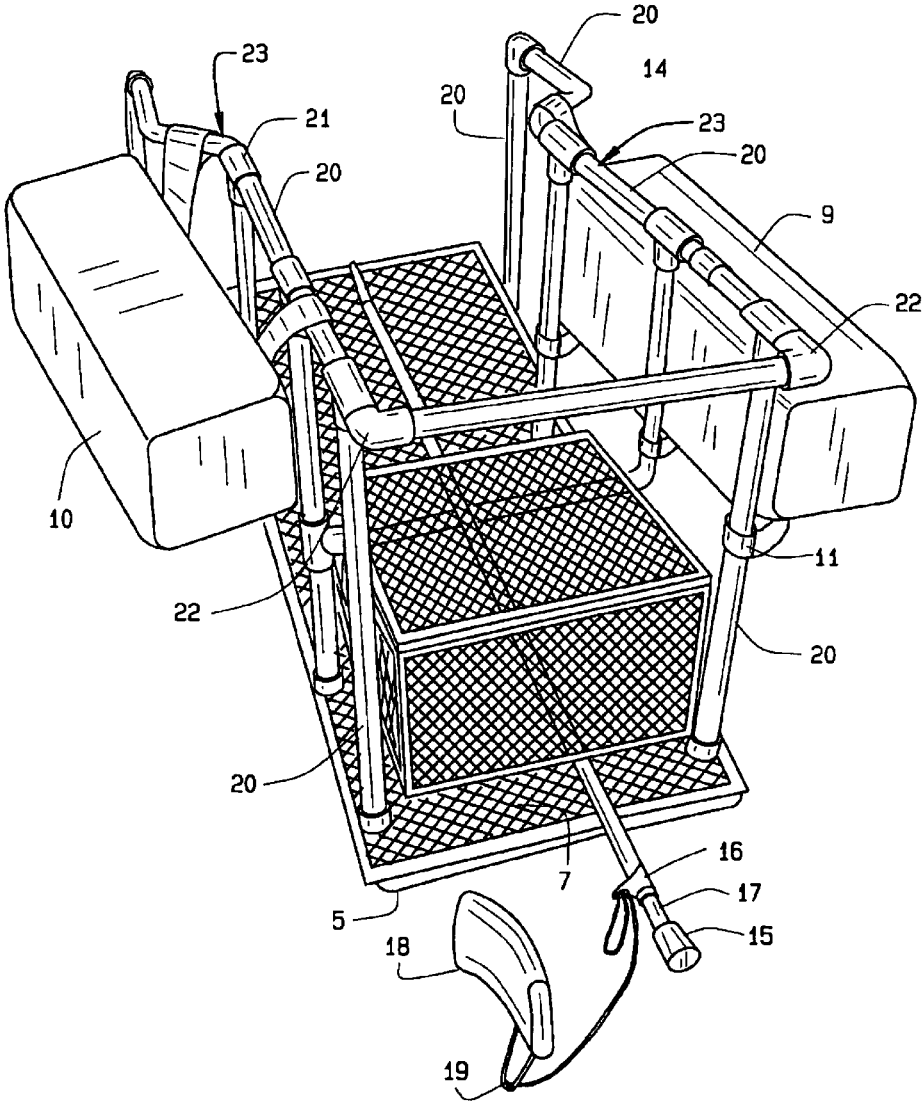
FIG. 2 shows a back view, or boat proximity side of the boat boarding device, when prepared for usage and application upon a vessel.

FIG. 2 discloses the boat side of the boarding device. As can be seen, the floatation devices 9 and 10 may be arranged in a position, as shown for the device, in greater proximity to the transom or back of the boat, or the floatation device may be slid forwardly, as can be seen at 10, to add more uniform support for the entire device, when rested in the water. While not shown, the bottom of the floatation devices 9 and 10 may also be held by straps, or other fasteners (not shown), to the upright portions of the side frames, to assure that the floatation devices remain in their erect and usable position, as can be seen in FIGS. 1 and 2. Straps maybe located approximate to the bottom of the floatation devices 9 and 10, as noted.

In addition, as can be seen in FIG. 2, the adjustment rod 12, which straps to the bottom platform 7, in order to hold the device 1 in position and to maintain its length, includes a cushioning bumper as at 15, for contacting the boat, when maintaining the boarding device horizontally in the water. Furthermore, the adjustment device may include a telescopic connection, such as through the usage of its sleeve 16, and the rods 17, so that the adjustment device can likewise be adjusted, into further lengths, or contracted, depending upon the proximity of the boat transom, or sides of the boat, when the device is installed for usage. Furthermore, the adjustment rod 12 may include its own floatation device 18, in case the rod becomes inadvertently separated from the platform, the floatation device 18 is capable of being suspended upon the water, for clear viewing and grasping, in the event of the rod becoming separated from its boarding device. Any type of a link 19 may be useful for holding the floatation device 18 to the rod, and the floatation device may be held in place within the raised platform 8, as can be seen, until it becomes freed, in the event that the rod inadvertently separates from the boarding device.

The framework of this invention may be formed of any type of materials as previously reviewed. It may be formed of polyvinyl chloride type of tubing. If so, such tubing can be assembled from a variety of lineal lengths, as generally categorized at 20, and these components may be held together through the use of tee-sections, as shown at 21, or elbows, as shown at 22, when the device is assembled for usage. In addition, the bottom framework, as at 5, may be assembled of similar components into an integral framework. In addition, the side rails, as at 23, while having their bulges 14 provided for widening of the framework, and the boarding device, at its back or water exposed end, these side rails may also be formed straight, or of lineal sections, without the widening feature 14, which will facilitate the folding of the side frameworks 3 and 4 as the device is collapsed for storage, or while it is being installed, or removed, from the boat.

Figure 3:
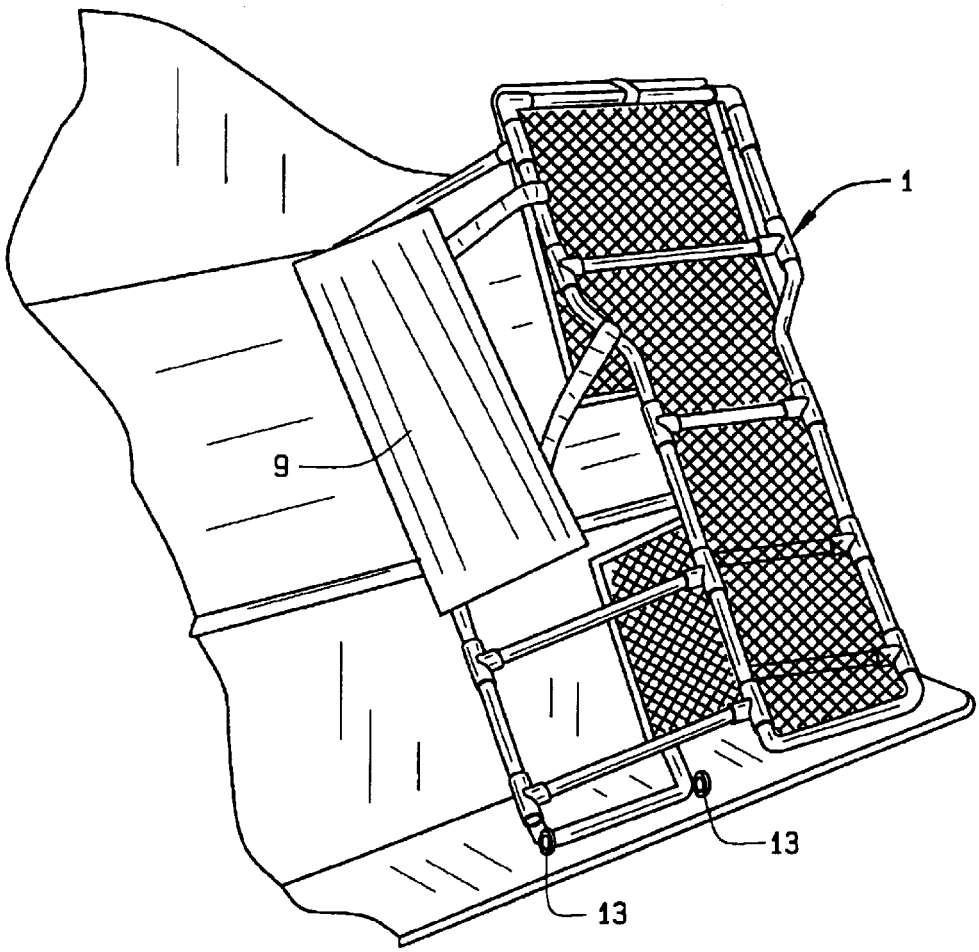
FIG. 3 shows the boat boarding device when pivoted upwardly into its non-usable and storage position, as along the transom of a boat.

FIG. 3 discloses the boat boarding device 1 of this invention as being pivoted upwardly, out of the water, along its hinged connection, as at 13, to the transom of a boat, or one of the sides of a boat, into a non-usable position, such as when the boat is traveling fast through the water. As can be determined, when the device is prepared for usage and application it can simply be pivoted downwardly, into the water, and suspended therein, partially, through the usage of its floatation devices, the one as shown at 9, and also through the application of its adjustment means, such as the rod 12, and its relationship to the back of the boat, and its hinged connection at 13, to sustain a reasonably horizontal disposition for the boarding device, proximate the back of a boat, during usage. Any type of fastener or strap (not shown) may be used for holding the boarding device in its raised or non-usable position, relative to the boat, as can be seen in FIG. 3. Any other type of fastening means or strap may be used for simply securing the device at its upper end, to the boat, to sustain its non-useable position, when not in use.

Figure 4:
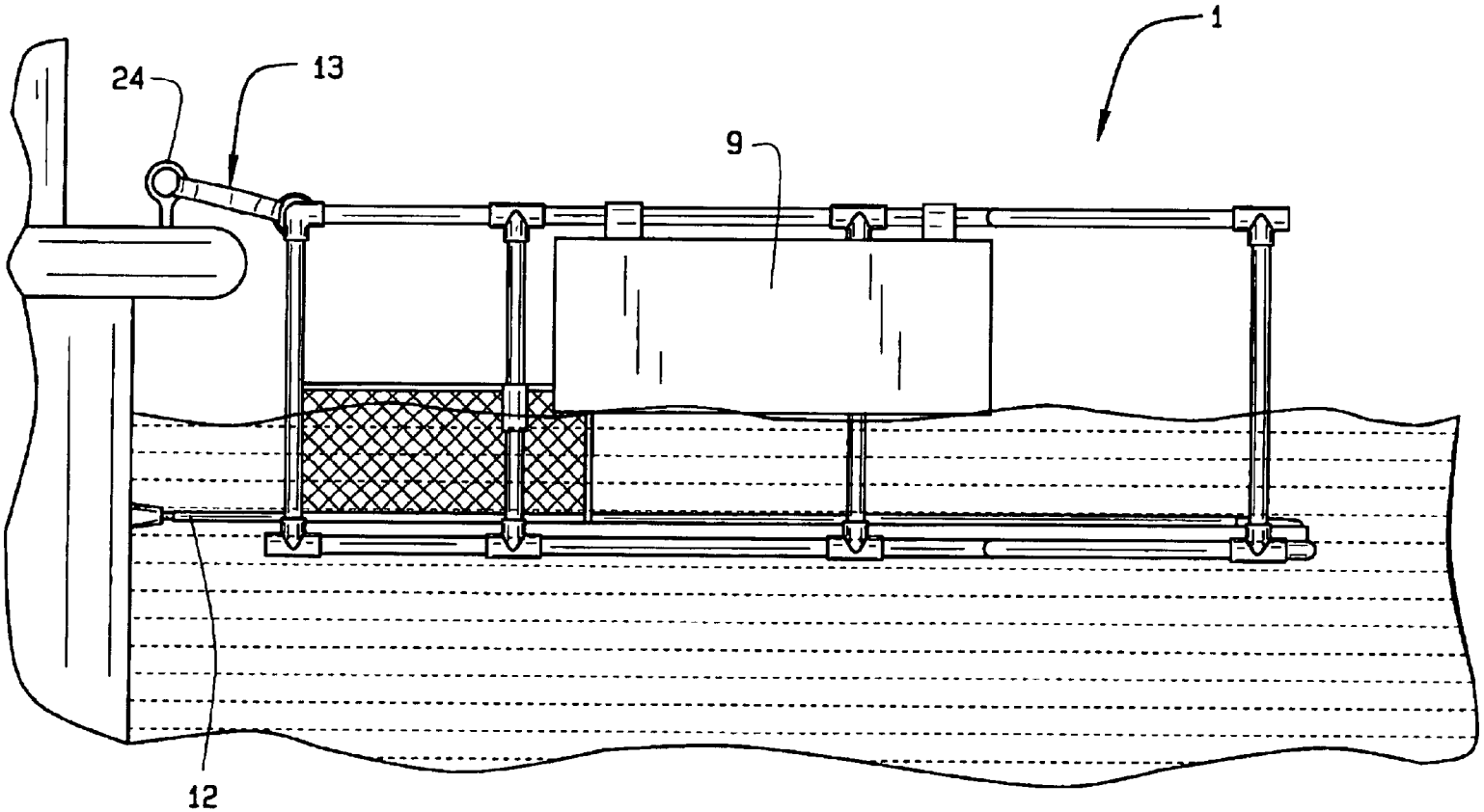
FIG. 4 is a side view of the boat boarding device when assembled and pivoted into the water, in preparation for usage.

FIG. 4 provides a side view of the boat boarding device 1 of this invention. As seen, the hinged means 13, or strap, or other connecting means, can be used for holding the device, at its upper end, to the eyelets, or other connecting means, secured to the boat transom or side, as noted at 24. The adjustment rod 12 can also adjust and extend towards the boat, so that in combination with the hinge means 13 the adjustment rod 12 can provide for a generally horizontal disposition for the device, during usage. This feature, in combination with the floatation devices, such as 9 and 10, maintains the boat boarding device in a generally horizontal configuration, as noted in this figure, and assists the swimmer, or other aquatic adventurer, while departing from the boat into the water, or vice versa, during application of this device.

The adjustment rod 12, as previously described, can undertake a variety of structures. For example, there may be telescopic rods that may extend from the back side ends of the lower framework 5, so as to provide two adjustment devices for resting against the boat, and to maintain horizontal stability. Or, any other type of spacer device, such as a spring biased means, PVC or other metallic tubing, that may connect with the lower framework 5, at its boat side, and for providing that spacing to maintain horizontal stability for the device, when pivoted into the water, can be utilized for this purpose.

Variations of modifications to the subject matter of this invention may occur to those skilled in the art upon reviewing the summary of the invention as provided herein, and upon undertaking the study of the description of its preferred embodiment. Such variations, if within the spirit of this development, are intended to be encompassed within the scope of the invention as described herein. The depiction of the invention in the drawings, and as described in the specification, is done so for illustrative purposes only.

I claim:

1. A device temporarily located within water adjacent to a facility, or boat, to assist in boarding the boat, comprising:

a framework having a front end proximate to the boat and a back end opposite the boat;

a platform as the base of said framework and hingedly connected to said framework;

a step located upon said platform towards said front end;

one or more floatation means symmetrically arranged upon said frame, generally opposite said platform;

one or more adjusting rods coplanar and parallel to the longitudinal axis of said platform; and, hinge means linking said frame with said boat;

whereby the crew of the boat deploys said device into the water for passengers to enter the water by walking upon said step and then said platform, and to depart the water by swimming to said platform, walking upon said platform, and using said step to climb into the boat, thereafter the crew retrieves said device upon the hinge means and stores the device upon the boat.

2. The boarding device of claim 1 further comprising:

said framework having a bottom frame to support said platform, two or more mutually spaced apart and generally parallel side panels perpendicular to said bottom frame having siderails, and a front frame rail spanning between said side panels at the front end of said device and said hinge means connecting with said front frame rail.

3. The boarding device of claim 2 further comprising:

said framework having tubular members connected by fittings whereby water passes freely through said bottom frame, said side panels, and said front frame rail.

4. The boarding device of claim 3 further comprising: said members and said fittings being polyvinyl chloride, nylon, or high density polyethylene.

5. The boarding device of claim 1 wherein said platform is an open mesh screen upon said framework and said step is an open mesh box.

6. The boarding device of claim 1 further comprising:

said adjusting rod having a sleeve at the fore end of said device, a telescoping rod within said sleeve, a bumper upon said rod for contact with a boat, a link extending from said sleeve, and a float connected to said link;

whereby, said rod slides within said sleeve to maintain said device level as said bumper contacts the various shapes of the hull of a boat, and, said float extends upon said link thereby marking the general location of said adjusting rod.

7. The boarding device of claim 1 wherein said hinge means is one of straps connected by rings to said front frame rail and rings upon a boat whereby said device floats independently from said boat, or a hinge between said front frame rail and said boat whereby said device floats with said boat.

8. The boarding device of claim 1 wherein said flotation means is one of foam, wood, pontoons, or air bladders and said flotation means is secured to said side rails thus maintaining said step at water level.

9. The boarding device of claim 2 wherein said back end of said device is wider than said front end, said siderails and said bottom frame have a bend to accommodate a wider back end of said device.

* * * * *